United States Patent [19]

Kuroda

[11] Patent Number: 4,622,005

[45] Date of Patent: Nov. 11, 1986

[54] IGNITION AND FLAME MONITORING DEVICE

[75] Inventor: Sinji Kuroda, Nagoya, Japan

[73] Assignee: Rinnai Corporation, Aichi, Japan

[21] Appl. No.: 784,295

[22] Filed: Oct. 7, 1985

[30] Foreign Application Priority Data

Oct. 27, 1984 [JP] Japan ..... 59-226165

[51] Int. Cl.[4] ..... F23N 5/00

[52] U.S. Cl. ..... 431/78; 431/25

[58] Field of Search ..... 431/25, 59, 66, 71, 431/74, 75, 78; 361/253; 307/117; 340/577, 579

[56] References Cited

U.S. PATENT DOCUMENTS 4,304,545 12/1981 Matthews ..... 431/25
4,405,299 9/1983 Serber ..... 431/78
4,413,303 11/1983 Cheary et al. ..... 431/25 X
4,519,771 5/1985 Six et al. ..... 431/25
4,552,528 11/1985 Gaiffier ..... 431/25

*Primary Examiner*—Margaret A. Focarino
*Attorney, Agent, or Firm*—Nilsson, Robbins, Dalgarn, Berliner, Carson & Wurst

[57] ABSTRACT

An ignition and flame monitoring device in which the absence of flame between a pair of sparking electrodes energizes the primary coil of a transformer through an ignition control circuit to step up the voltage of the secondary coil thereof so as to develop a Zener diode into an avalanche breakdown. This causes a spark between the gap electrodes to ignite the flammable gas, building a flame which increases electrical conduction between the electrodes to transmit a flame signal causing a flame detection circuit to deenergize the primary transformer coil so as to stop the electrode spark.

3 Claims, 3 Drawing Figures

IGNITION AND FLAME MONITORING DEVICE

PRIORITY CLAIM

This application claims priority under 35 USC 119 from Japanese patent application Ser. No. 59-226165, filed Oct. 27, 1984.

FIELD OF THE INVENTION

The field of art to which the invention pertains is the field of gas room heaters.

BACKGROUND AND SUMMARY OF THE INVENTION

This invention relates to an ignition and flame monitoring device in which sparking electrodes are employed for flame detection.

A device of this type is employed, for example, in a warm air-current generator fueled by flammable gas. This device has a pair of sparking gap electrodes, a transformer which applies a step-up voltage between the electrodes, and a flame detecting condensor connected in parallel with the electrodes so as to ignite the gas by a spark built up between the electrodes upon using the warm air-current generator. Flame developed between the electrodes by the ignition permits direct current to flow therebetween to charge the condensor. The condensor thus charged activates a flame detecting circuit for detecting the presence of the flame so as to cease the spark at the time of ignition.

The prior art device thus described needs a condensor and poses problems such as those raised below. Manufacturing cost goes up with the high cost of the condensor. An alternating current source is invariably employed due to utilizing the rectifying action of the flame. A condensor renders a slow flame detection in response to the flame built up between the gap electrodes due to leakage current therefrom. Condensors involved have a variance of time required to be completely charged, and are therefore incapable of expecting a uniform detection.

Therefore, it is a first object of the invention to provide an ignition and flame monitoring device which utilizes an electrically conductive action of the flame instead of the rectifying action to obviate the usual need of an alternate current source.

It is a third object of the invention to provide an ignition and flame monitoring device which is capable of instantaneously detecting flame presented between electrodes, insuring a quick detecting response to the flame built up therebetween.

It is a fourth object of the invention to provide an ignition and flame monitoring device which is capable of producing a uniform igniting action, obviating the need of a condensor.

According to this invention, the absence of flame between the electrodes energizes the primary coil of a transformer through an ignition control circuit to step up the voltage of the secondary coil thereof so as to develop a Zener diode into an avalanche breakdown. This causes a spark between the gap electrodes to ignite flammable gas through a pilot burner to build a flame therebetween. The flame renders electrical conduction between the electrodes to transmit a flame signal to a flame detecting circuit. The flame detecting circuit deenergizes the primary coil of the transformer so as to cease the spark between the gap electrodes through the ignition control circuit.

DETAILED DESCRIPTION

Figure 1:
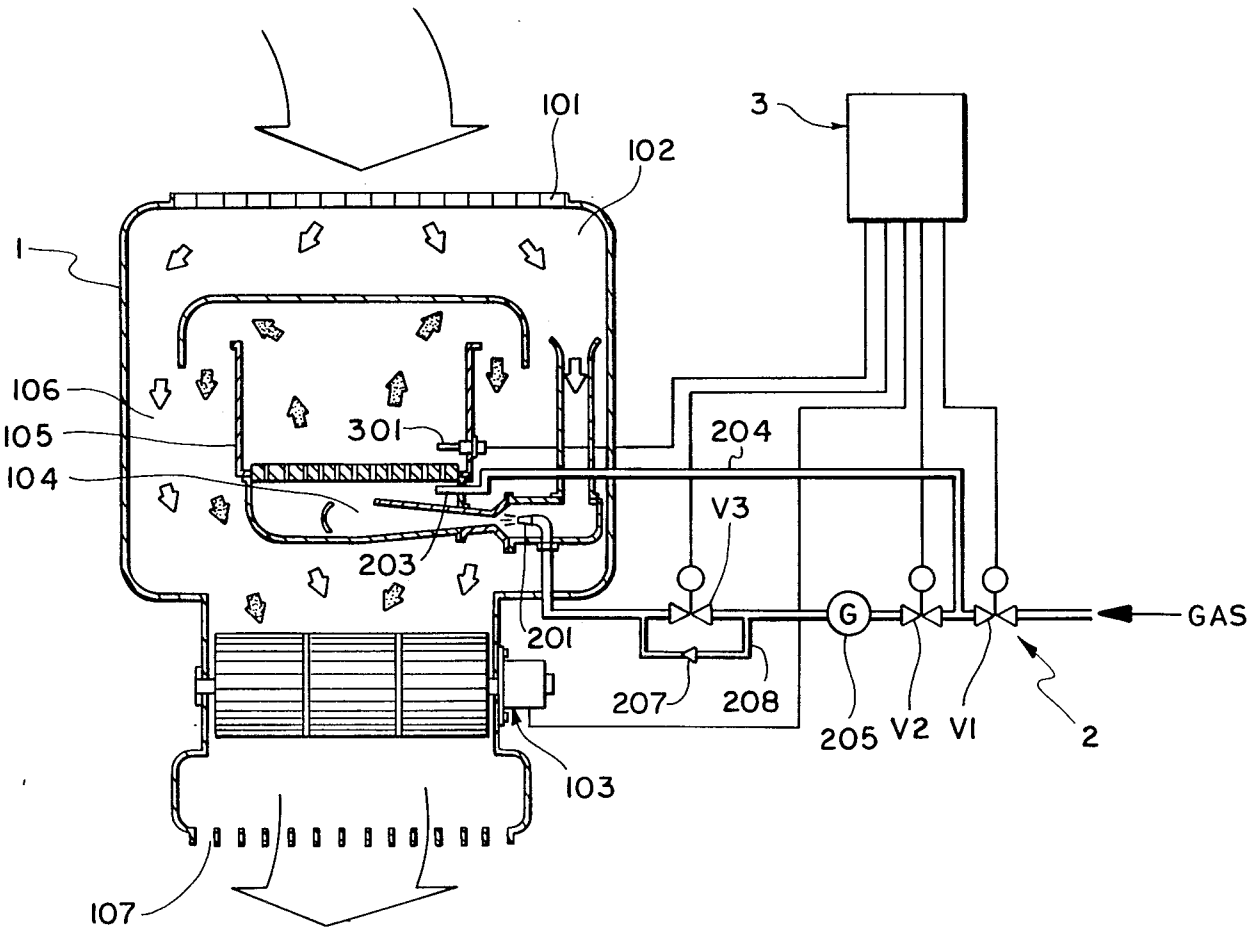
FIG. 1 is a skeletal view of a warm air-current generator.

Referring first to FIG. 1 in which a warm air-current generator is shown. The generator has a casing 1 which has an air inlet grille 102 having a mesh filter 101, and an air outlet louver 107 positioned opposite to the grille 102. With the casing 1 are a mixing cell 104 for mixing air with gas, a burner plate 105 for burning the mixed gas, and a condition cell 106 for joining the burnt gas with outer air provided. A blower 103 introduces the outer air into the casing 1 through the grille 102, and discharges the gas at the conditioning cell 106 from the louver 107 for supplying a warm air-current.

On the other hand, a gas supply conduit 2 has one end communicating with a gas source (not shown), and the other end projecting into the casing 1 to position in the proximity of the burner plate 105 to carry a nozzle 201. The conduit 2 carries a first electromagnetic solenoid valve V1, a second electromagnetic solenoid valve V2, a regulator valve 205 and a third electromagnetic solenoid valve V3 in series along the length from the gas source to the nozzle 301.

Between the valves V1 and V2, a conduit 204 is provided, one end of which projects into the casing 1 to constitute a pilot burner 203 which positions as if sandwiching the burner plate 105 with a hereafter-described electrode 301. A bypassed conduit 208 is provided with the gas supply conduit 2 so as to allow the nozzle 201 to always emit a certain quantity of gas by means of a flow regulator 207.

Figure 2:
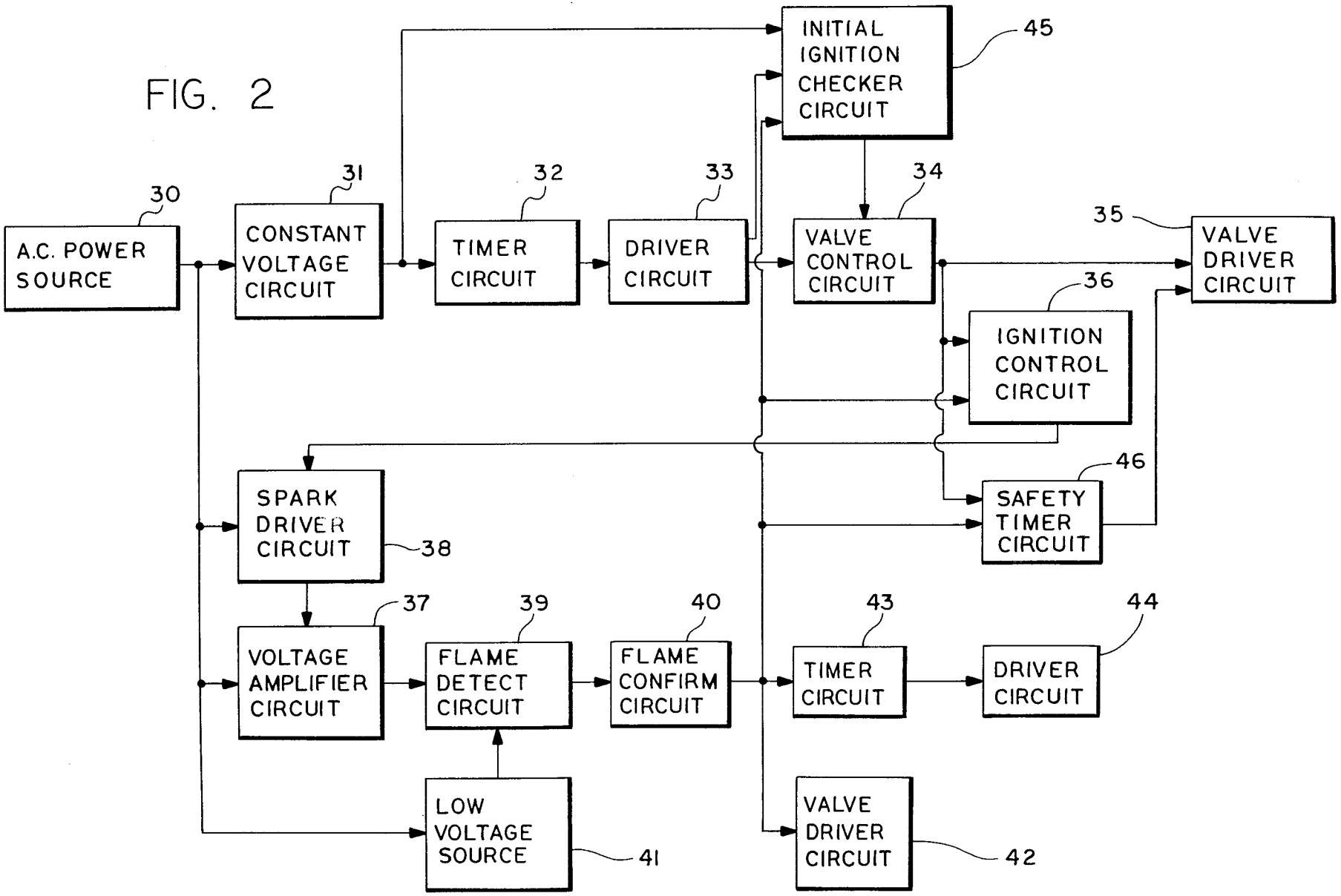
FIG. 2 is a block diagram of an electronic circuit incorporated into the warm air-current generator.

An electronic circuit, designated at numeral 3, controls the sparking electrodes 301, the blower 103, and the first, second and third valves V1, V2, V3. In the circuit 3, a constant-voltage circuit 31 converts an A.C. power source of such as, for example, 24 V into D.C. current as seen in FIG. 2. A timer circuit 32 delays to drive the blower 103 by the predetermined period of time when energized from the constant-voltage circuit 31. A driver circuit 33 energizes the blower 103 with the output signal generated from the timer circuit 32 in response to the time lag predetermined by the circuit 32. A valve control circuit 34 energizes the first valve V1 to displace it between open and closed positions through a valve driver circuit 35. An ignition control circuit 36 directs to develop a spark between the electrodes 301 through the output signal from the valve control circuit 34. A voltage amplifier circuit 37 has a transformer carrying a primary coil (not shown) to establish a step-up voltage enough to spark between the electrodes 301. A spark driver circuit 38 energizes the primary coil on the basis of the output signal from the ignition control circuit 36. A flame detection circuit 39 detects the presence of flame between the gap electrodes 301 in response to the spark that appears therebetween due to the primary coil energized through the spark driver circuit 38. The spark between the electrodes ignites the gas emitting from the pilot burner 203 to build up a flame positioned between the electrodes 301.

A flame confirm circuit 40 which is connected to a low voltage source 41 is energized to confirm the presence of flame between the electrodes 301 due to the flame therebetween. A valve driver circuit 42 is directed to open and close the second valve V2 through the output signal of the flame confirm circuit 40. A timer circuit 43 delays to open the third valve V3 for a certain time period in response to flame confirmation of the flame confirm circuit 40. A driver circuit 44 actuates to open and close the third valve V3 due to the output signal from the timer circuit 43. An initial ignition checker circuit 45 checks an abnormal condition in which the flame confirm circuit 40 generates the flame detection signal while supplying the power source 30 although the timer circuit 32 of the blower 103 is still working. This instance directs the checker circuit 45 to generate the output signal so as to suspend the actuation of the valve control and ignition control circuits 35, 36. A safety timer circuit 46 activates the valve driver circuit 35 to close the valve V1 upon checking an abnormal condition in which the timer circuit 46 receives no flame detection signal within the predetermined period of time when the valve control circuit 34 actuates to open the valve V1 through the valve driver circuit 35, while driving the blower 103 by the driver circuit 33 due to the output signal from the valve control and the flame confirm circuits 34, 40. The ignition control 36 is adapted to direct the spark driver 38 so as to deenergize the primary coil of the transformer for extinguishing the spark between the electrodes 301 when the circuit 36 receives the flame detection signal from the flame confirm circuit 40.

Figure 3:
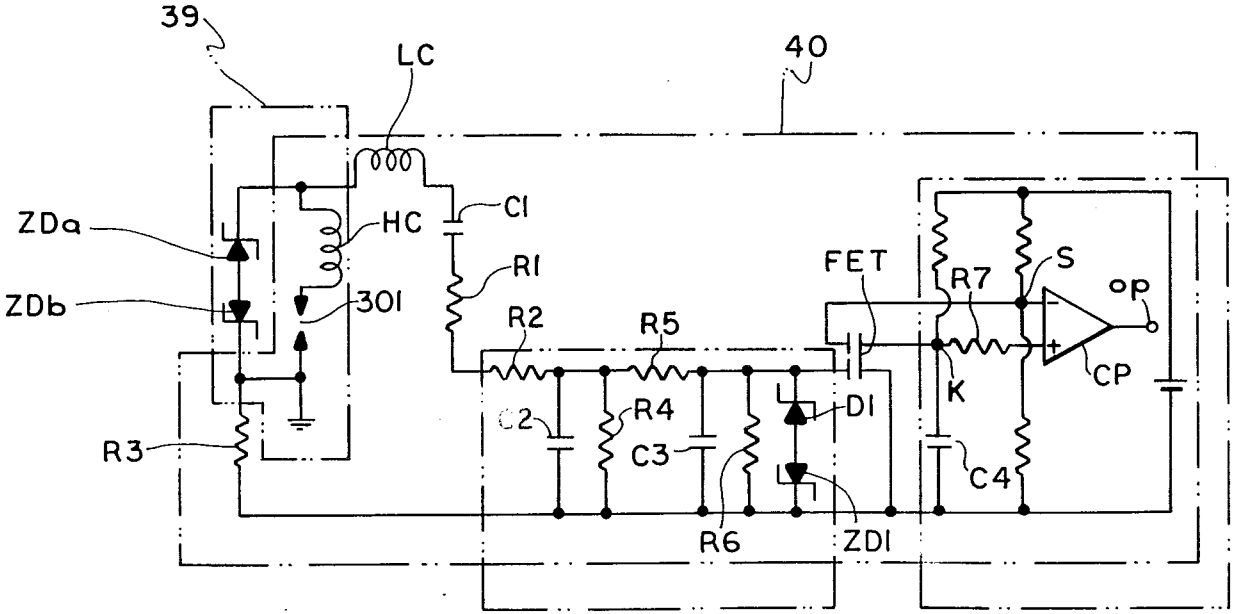
FIG. 3 is an electronic circuit network according to one embodiment of the invention.

A detailed circuit network regarding to the flame detecting circuit 39 and the flame confirm circuit 40 is shown in FIG. 3 in which the low voltage source 41 has a low voltage transformer, the primary coil of which is adapted to supply A.C. current to the flame detection circuit 40 through the power source 30. The flame detection circuit 39 has the gap electrodes 301, the secondary coil HC of the transformer connected in series with the electrodes 301, and the secondary coil LC of the low voltage transformer energized upon appearance of a flame between the electrodes 301. The low voltage transformer connects its secondary coil LC in series through a condensor C1 and a resistance R1 to a low pass filter network including condensors C2, C3, resistances R2~R6, a diode D1 and a Zener diode ZD1. The low pass filter network is connected through a Field Effect Transistor FET to a flame detector network including a resistance R7, a condensor C4 and a comparator CP.

On the other hand, in parallel with the coil HC and the electrodes 301 is a pair of Zener diodes ZDa, ZDb connected in series with the negative polarities opposing each other. Each of the Zener diodes has opposing n-type semiconductors, and the Zener diodes determine the breakdown voltage between voltage applied from the secondary coil HC and that from the secondary coil LC of the low voltage transformer so as to develop into an avalanche breakdown due to the voltage from the secondary coil HC, rendering immune to A.C. current from the secondary coil LC.

With the structure thus described, the A.C. power source develops A.C. voltage across the secondary coil LC through the energized low voltage transformer. At the absence of flame between the gap electrodes 301, the Zener diodes impede the voltage of the coil LC to apply to the flame confirm circuit 40, rendering the output terminal OP of the comparator CP to a low level with the potential at S being higher than that at K to indicate that the pilot burner 203 produces no flame. In this instance, the valve control circuit 34, once energized, actuates to open the first valve V1 through the valve driver circuit 35, at the same time, commanding that the ignition control circuit 36 energizes the primary coil of the transformer at the voltage amplifier circuit 37 through the spark driver circuit 38. This induces the step-up voltage across the secondary coil HC to develop the Zener diodes into an avalanche breakdown, establishing a spark between the electrodes 301. The spark thus established ignites the gas from the burner 203 to produce a flame which appears between the electrodes 301, rectifying A.C. voltage of the secondary coil LC to energize the flame confirm circuit 40 so as to turn the output terminal OP of the comparator CP from the low level to a high level with the potential at S dropping lower than that at K, indicating that the pilot burner 203 is allowed to ignite the gas therefrom and producing a flame. This induces the flame confirm circuit 40 to generate an ignition signal so that the ignition control circuit 36 deenergizes the primary coil at the voltage amplifier circuit 37 through the spark driver circuit 38 to cause the voltage across the secondary coil HC to disappear so as to cease the spark between the electrodes 301.

As is apparent from the foregoing description, the ignition of the gas is due to the gap electrodes 301, the spark of which is induced by the Zener diodes developed into an avalanche breakdown, rendering the comparator into a high level. This is capable of obviating the need of a capacity or condensor, the discharge of which may turn a comparator to a high level in the prior art counterparts, leading to the relief of high manufacturing costs, while insuring a quick detecting response to the flame presented between the gap electrodes. With no need of a condensor, a uniform igniting action is readily anticipated in opposition to the counterpart devices in which a condensor is involved in variation of the charging time period. It is not always necessary for the gap electrodes 301 to rectify the current flowing therebetween. An electrical conduction between the gap electrodes 301 is sufficient upon turning the output terminal of the comparator to a high level so that the usual need of A.C. current is eliminated.

It is noted that a voltage regulator may be incorporated into the constant voltage circuit 31 to provide an output voltage of least fluctuation. In this invention, the ignition and flame monitoring device is associated with a warm air-current generator, however, the device may be applied to wide varieties of burners for water boiling apparatus, bath shower equipment or the like regardless of the kinds of fuel such as flammable gas or petroleum.

Although the invention has been shown and described with respect to a preferred embodiment thereof, it should be understood by those versed in the art that various changes and omissions of the form and detail thereof may be made therein without departing from the scope and spirit of the invention.

I claim:

1. An ignition and flame monitoring device comprising:

(a) sparking electrode members for igniting by a spark flammable gas issued from a burner and serving as a flame detecting element;

(b) a voltage transformer having a secondary coil connected in series with said sparking electrode members;

(c) a flame detection circuit connected in series with said sparking electrode members and said secondary coil of said voltage transformer so as to detect the presence or absence of the flame between said electrode members;

(d) a low voltage source connected in series with said flame detection circuit;

(e) an ignition control circuit adapted so that said transformer interrupts a voltage supply of said secondary coil by an output signal from said flame detection circuit upon building up a flame between said electrode members; and (f) a voltage regulation diode member connected in parallel with said sparking electrode members and said secondary coil of said transformer, ,and the breakdown voltage being adapted to be between voltage supplied from said lower voltage source and that supplied from said secondary coil of said transformer so as to electrically disconnect between said lower voltage source and said flame detection circuit when subjected to voltage from said secondary coil of said transformer due to the occurrence of an avalanche breakdown inducing said spark.

2. An ignition and flame monitoring device as recited in claim 1, wherein said low voltage source is alternating current, while said voltage regulation diode member is a Zener diode having opposing n-type semiconductors.

3. An ignition and flame monitoring device as recited in claim 1 or claim 2, wherein said flame between said electrode members rectifies the alternate current from said low voltage source.

* * * * *